US010843472B2

(12) United States Patent
Ichihara et al.

(10) Patent No.: US 10,843,472 B2
(45) Date of Patent: Nov. 24, 2020

(54) LIQUID HOUSING CONTAINER, LIQUID HOUSING APPARATUS, AND LIQUID EJECTING APPARATUS

(71) Applicant: SEIKO EPSON CORPORATION, Tokyo (JP)

(72) Inventors: Keita Ichihara, Matsumoto (JP); Kazuyuki Hirata, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/577,788

(22) Filed: Sep. 20, 2019

(65) Prior Publication Data

US 2020/0094566 A1 Mar. 26, 2020

(30) Foreign Application Priority Data

Sep. 21, 2018 (JP) ..... 2018-177080

(51) Int. Cl.
*B41J 2/175* (2006.01)

(52) U.S. Cl.
CPC .. *B41J 2/17513* (2013.01); *B41J 2002/17516* (2013.01)

(58) Field of Classification Search
CPC ..... B41J 2/17513; B41J 2002/17516; B41J 2/17523; B41J 2/1753; B41J 2/17553; B41J 2/17509
USPC ..... 347/86
See application file for complete search history.

(56) References Cited

U.S. PATENT DOCUMENTS 6,220,702 B1 * 4/2001 Nakamura ..... B41J 2/17503 206/524.8
2002/0122084 A1 * 9/2002 Shihoh ..... B41J 2/17553 347/7

FOREIGN PATENT DOCUMENTS

JP 2001-130637 A 5/2001
JP 2014-069314 A 4/2014
JP 2016-129997 A 7/2016

* cited by examiner

*Primary Examiner* — Huan H Tran
*Assistant Examiner* — Alexander D Shenderov
(74) *Attorney, Agent, or Firm* — Oliff PLC

(57) ABSTRACT

A liquid housing container includes a suppressing portion at one end portion of a first surface-portion film and one end portion of a second surface-portion film, and at another end portion of the first surface-portion film and another end portion of the second surface-portion film. The suppressing portion suppresses spreading of a gap between the one end portion of the first surface-portion film and the one end portion of the second surface-portion film, and spreading of a gap between the other end portion of the first surface-portion film and the other end portion of the second surface-portion film.

8 Claims, 13 Drawing Sheets

LIQUID HOUSING CONTAINER, LIQUID HOUSING APPARATUS, AND LIQUID EJECTING APPARATUS

The present application is based on, and claims priority from JP Application Serial Number 2018-177080, filed Sep. 21, 2018, the disclosure of which is hereby incorporated by reference herein in its entirety.

BACKGROUND

1. Technical Field

The present disclosure relates to a liquid housing container, a liquid housing apparatus, and a liquid ejecting apparatus.

2. Related Art

To date, a liquid housing container in which flexible films are heat welded to each other is known. For example, in a liquid housing container described in JP-A-2014-69314, the heat welding width of the flexible films is increased. In addition, an inside-foldable gusset portion is formed at a liquid housing container described in JP-A-2016-129997, and a portion of a seal portion forming an edge of the gusset portion is joined to a portion of an opposing seal portion to form a gusset joint portion. Thereby, for example, the impact resistance of the liquid housing container against drops or the like is increased.

However, in the liquid housing container of JP-A-2014-69314, the heat welding width of the flexible films is increased to further increase the area of the flexible films to be heat welded. Thus, there is a problem in that the amount of liquid that can be housed is decreased by that much, and the volume efficiency has declined.

In addition, in the liquid housing container of JP-A-2016-129997, the specification of the position of the gusset joint portion has not been verified by experiments or the like. That is, there is a problem that the optimum position of the gusset joint portion is not clear.

SUMMARY

According to an aspect of the present disclosure, a liquid housing container includes: a flexible bag configured to contain a liquid; and a lead-out portion that is coupled to the flexible bag and communicating with inside and outside of the flexible bag, in which the flexible bag includes a first surface-portion film that is flexible and rectangular, a second surface-portion film that is flexible, rectangular, and provided opposite the first surface-portion film, a first side-portion film that is flexible and welded to one end portion on a long side of the first surface-portion film and one end portion on a long side of the second surface-portion film, a second side-portion film that is flexible and welded to another end portion on the long side of the first surface-portion film opposite to the one end portion on the long side of the first surface-portion film and another end portion on the long side of the second surface-portion film opposite to the one end portion on the long side of the second surface-portion film, the first side-portion film and the second side-portion film having a surface area smaller than a surface area of the first surface-portion film and the second surface-portion film, and a suppressing portion that is provided on the one end portion on the long side of the first surface-portion film and the one end portion on the long side of the second surface-portion film, and the other end portion on the long side of the first surface-portion film and the other end portion on the long side of the second surface-portion film, and that suppresses expansion of a space between the one end portion on the long side of the first surface-portion film and the one end portion on the long side of the second surface-portion film and expansion of a space between the other end portion on the long side of the first surface-portion film and the other end portion on the long side of the second surface-portion film.

In the liquid housing container, when one end portion on a short side of the first surface-portion film and one end portion on a short side of the second surface-portion film corresponding to the one end portion on the short side of the first surface-portion film are set as a top end portion, and another end portion on an opposite side to the one end portion on the short side of the first surface-portion film and another end portion on an opposite side to the one end portion on the short side of the second surface-portion film are set as a bottom end portion, the lead-out portion may be provided on a top end portion side, and the suppressing portion may be provided at a position closer to a bottom end portion side than the top end portion side, and may be provided at a position separated from the bottom end portion toward the top end portion.

In the liquid housing container described above, the suppressing portion may be provided at a distance of 25 mm or more and 100 mm or less from the bottom end portion.

In the liquid housing container, among a width between the one end portion on the long side of the first surface-portion film and the one end portion on the long side of the second surface-portion film, and a width between the other end portion on the long side of the first surface-portion film and the other end portion on the long side of the second surface-portion film, the width of portions where the suppressing portion is provided may be narrower than the width of portions where the suppressing portion is not provided.

In the liquid housing container, the suppressing portion may be formed by respectively pinching, with an adhesive tape, the one end portion on the long side of the first surface-portion film and the one end portion on the long side of the second surface-portion film, and the other end portion on the long side of the first surface-portion film and the other end portion on the long side of the second surface-portion film.

In the liquid housing container, the suppressing portion may be formed by respectively welding the one end portion on the long side of the first surface-portion film and the one end portion on the long side of the second surface-portion film, and the other end portion on the long side of the first surface-portion film and the other end portion on the long side of the second surface-portion film.

According to another aspect of the present disclosure, a liquid housing apparatus includes the liquid housing container and a holder for storing the liquid housing container.

According to yet another aspect of the present disclosure, a liquid ejecting apparatus includes the liquid housing apparatus.

DESCRIPTION OF EXEMPLARY EMBODIMENTS

Hereinafter, embodiments of the present disclosure will be described with reference to the accompanying drawings. Further, in each of the following diagrams, in order to make each member and the like be recognizable, the scale of each member and the like differs from actuality.

First Embodiment

Figure 1:
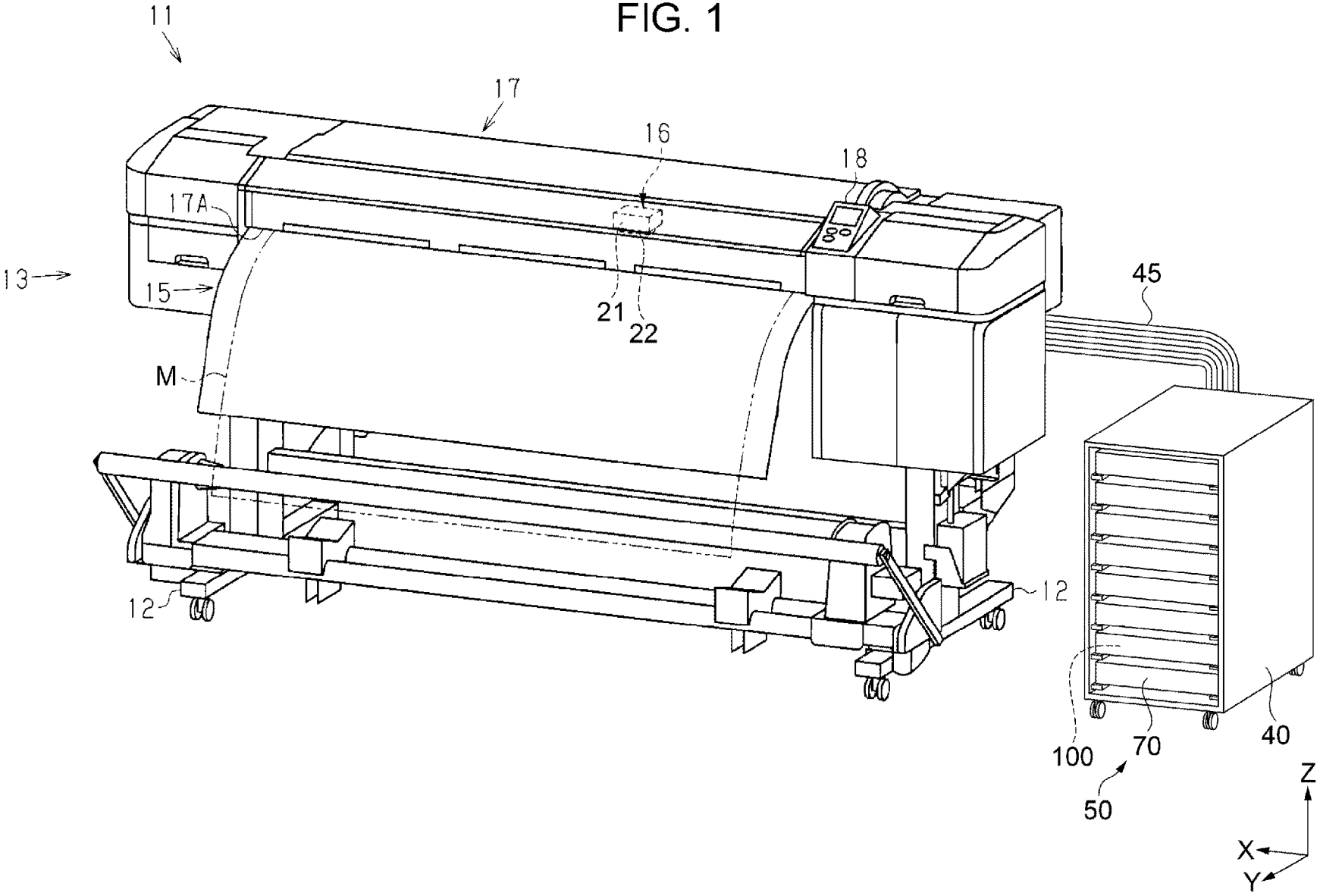
FIG. 1 is a perspective view illustrating a configuration of a liquid ejecting apparatus according to a first embodiment.

First, a configuration of a liquid ejecting apparatus 11 will be described. FIG. 1 is a perspective view illustrating the configuration of the liquid ejecting apparatus 11. The liquid ejecting apparatus 11 according to the present embodiment is, for example, an ink jet printer that performs printing by ejecting ink, which is an example of a liquid, onto a medium.

As illustrated in FIG. 1, the liquid ejecting apparatus 11 is a large format printer (LFP) that handles a long continuous paper sheet M, which is an example of a medium, and, includes an apparatus main body 13 supported by, for example, a pair of legs 12 mounted on a floor surface. The pair of legs 12 and the apparatus main body 13 are provided with a transport unit that transports the continuous paper sheet M by a roll-to-roll method from a roll body in which the continuous paper sheet M is wound in a roll shape. Further, the "front and rear", "left and right", and "upper and lower" directions referred to below correspond to directions when the apparatus main body 13 that is long in the X direction in FIG. 1 is viewed from the front.

The apparatus main body 13 includes a support portion 15 that supports the continuous paper sheet M transported by the transport unit, a printing unit 16 that performs printing on the continuous paper sheet M by ejecting ink onto the continuous paper sheet M in a printing area, and a casing 17 that covers the support portion 15 from the upper side and houses the printing unit 16. An operation unit 18 that performs an operation related to printing is provided on the right front side of the casing 17.

On the front side of the casing 17, a paper discharge port 17A through which the continuous paper sheet M transported in the apparatus main body 13 is discharged is provided on the front surface side of the apparatus main body 13.

The printing unit 16 includes a carriage 21 that is capable of reciprocating in the X direction. A print head 22 that ejects ink from a plurality of nozzles is mounted on the carriage 21.

The support portion 15 supports the continuous paper sheet M, and ink is ejected from the print head 22 toward the continuous paper sheet M supported by the support portion 15.

In addition, a liquid housing apparatus 50 that supplies ink to the printing unit 16 is disposed on the right hand side of the apparatus main body 13. In the present embodiment, multiple liquid housing apparatuses 50 are disposed in a housing unit 40. Each of the liquid housing apparatuses 50 includes a holder 70 in which is stored a liquid housing container 100 that is capable of housing ink. The liquid housing apparatus 50 and the print head 22 are coupled via a tube 45, and the ink can be supplied from the liquid housing container 100 to the print head 22. The housing unit 40 has coupling mechanisms that respectively couple to the liquid housing apparatuses 50. The liquid housing apparatuses 50 are configured to be coupled to the coupling mechanisms of the housing unit 40. In addition, the liquid housing apparatuses 50 are configured to be removable from the housing unit 40.

Next, the configuration of the liquid housing apparatus 50 will be described.

Figure 2:
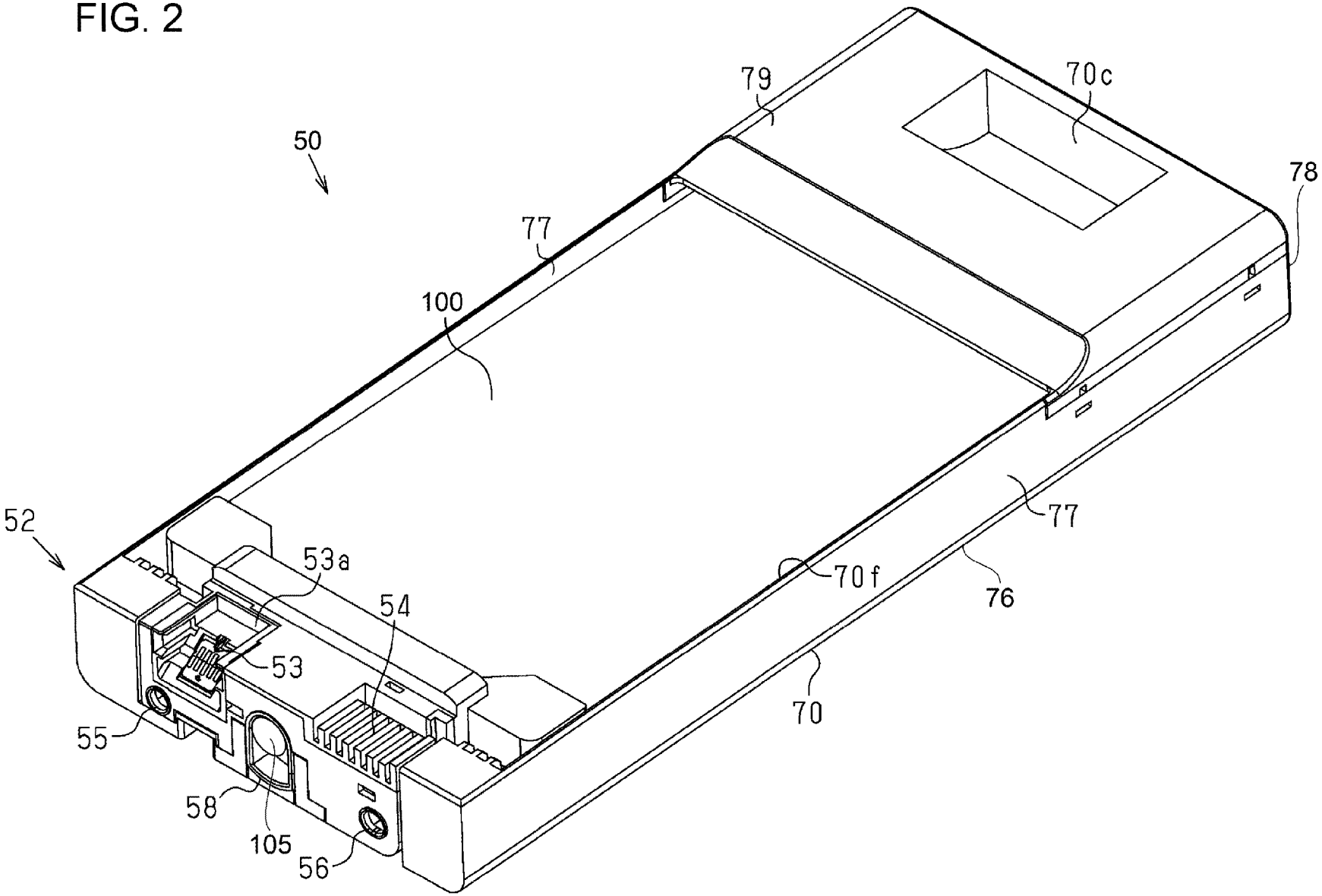
FIG. 2 is a perspective view illustrating a configuration of a liquid housing apparatus according to the first embodiment.

FIG. 2 is a perspective view illustrating the configuration of the liquid housing apparatus 50. FIG. 2 illustrates the liquid housing apparatus 50 in which the liquid housing container 100 is housed.

As illustrated in FIG. 2, the liquid housing apparatus 50 includes the liquid housing container 100 and the holder 70 in which is stored the liquid housing container 100. In addition, the liquid housing apparatus 50 includes a coupling portion 52 that couples to a corresponding coupling mechanism of the housing unit 40.

The holder 70 includes a bottom plate 76 that is substantially rectangular and that forms a bottom surface, side plates 77 standing vertically upright from both long-side-direction ends of the bottom plate 76, and a front plate 78 standing vertically upright from a short-side-direction end of the bottom plate 76.

In the holder 70, a space formed by the bottom plate 76, the side plate 77, and the front plate 78 is a storage space for storing the liquid housing container 100. The holder 70 has an opening 70*f* through which the liquid housing container 100 can be inserted into and removed from the storage space.

The surface of the bottom plate 76 in contact with the liquid housing container 100 is provided with irregularities by using ribs or embossing as necessary. In this way, when the liquid housing container 100, which is flexible, is stored, unnecessary movement of the liquid housing container 100 in the holder 70 can be suppressed.

In addition, a cover 79 covering a portion of the storage space is provided on a proximal-end-side portion of the holder 70. Consequently, even when the liquid housing container 100, which is flexible, is bent and deformed, protrusion from the storage space can be suppressed. In particular, because a bottom end portion 142 side of the liquid housing container 100 illustrated in FIG. 3 may warp upward when an amount of liquid housed in the liquid housing container 100 is reduced, by disposing the cover 79 in the holder 70 so as to cover the bottom end portion 142 side of the liquid housing container 100, protrusion of the bottom end portion 142 side of the liquid housing container 100 can be suppressed. Further, the cover 79 is fitted to the side plates 77 by claws or the like composed of small protruding pieces.

In addition, the holder 70 includes a handle 70*c* that can be hooked by a user's fingers. In the present embodiment, the cover 79 is provided with the handle 70*c*. The handle 70*c* is a recessed portion. Consequently, the user can easily handle the liquid housing apparatus 50 by hooking the handle 70*c* with his or her fingers. Further, the handle 70*c* is not limited to the recessed portion, and for example, a rib or emboss may be attached. Even in this case, the holder 70 can be made less slippery when grasped. As another form, for example, a handle for gripping may be provided on the front plate 78 in a protruding manner.

In addition, some or all of the holder 70, such as the cover 79 or the front plate 78, may be formed of a transparent member, or a transparent window may be fitted to the cover 79 or the front plate 78. In this way, when liquid leaks in the holder 70, it is possible to view the situation from the outside and quickly detect the leakage of liquid.

The coupling portion 52 is disposed at an end portion on the opposite side to the front plate 78 of the holder 70. The coupling portion 52 holds one end portion of the liquid housing container 100. The coupling portion 52 is provided with a through hole 58, and a lead-out portion 105 provided in the liquid housing container 100 is fitted into the through hole 58. In a state where the liquid housing apparatus 50 and the housing unit 40 are coupled to each other, the lead-out portion 105 and the tube 45 are coupled to each other.

The coupling portion 52 includes a coupling terminal 53. The coupling terminal 53 is provided, for example, on the surface of a circuit board, and the circuit board includes a storage unit that stores various types of information regarding the liquid housing container 100 such as the type of the liquid housing container 100 and the amount of liquid housed. The coupling mechanism side of the housing unit 40 is provided with coupling pins that electrically couple to the coupling terminal 53. The coupling pins are coupled to a control unit of the liquid ejecting apparatus 11. The liquid housing apparatus 50 is inserted into the housing unit 40, and when the coupling terminal 53 and the coupling pins of the coupling mechanism are coupled, various information of the liquid housing container 100 is read out by the control unit. In addition, the control unit can write to the storage unit via the coupling terminal 53.

The coupling terminal 53 is disposed in a recessed portion 53*a* provided in the coupling portion 52 in a diagonally facing attitude.

In addition, the coupling portion 52 also includes an identification portion 54 for preventing erroneous insertion. The identification portion 54 has irregularities having shapes that fit with the coupling mechanism of the housing unit 40.

In addition, the coupling portion 52 has a pair of positioning holes 55 and 56. The positioning holes 55 and 56 are arranged in the direction of the short side of the bottom plate 76 with the lead-out portion 105 interposed therebetween. Preferably, the positioning hole 55 is circular and the positioning hole 56 is long and oval.

Next, the configuration of the liquid housing container 100 will be described.

Figure 3:
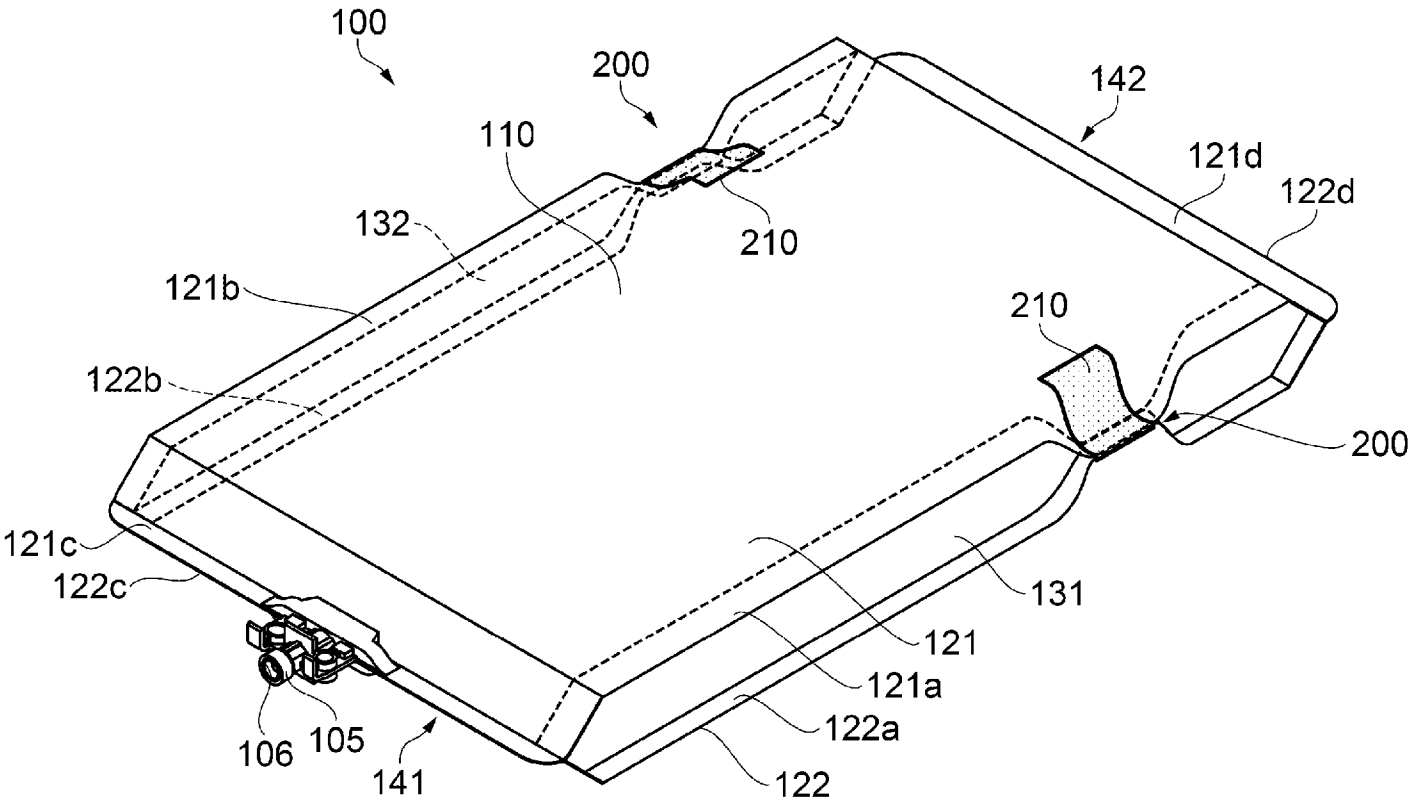
FIG. 3 is a perspective view illustrating a configuration of a liquid housing container according to the first embodiment.
Figure 4:
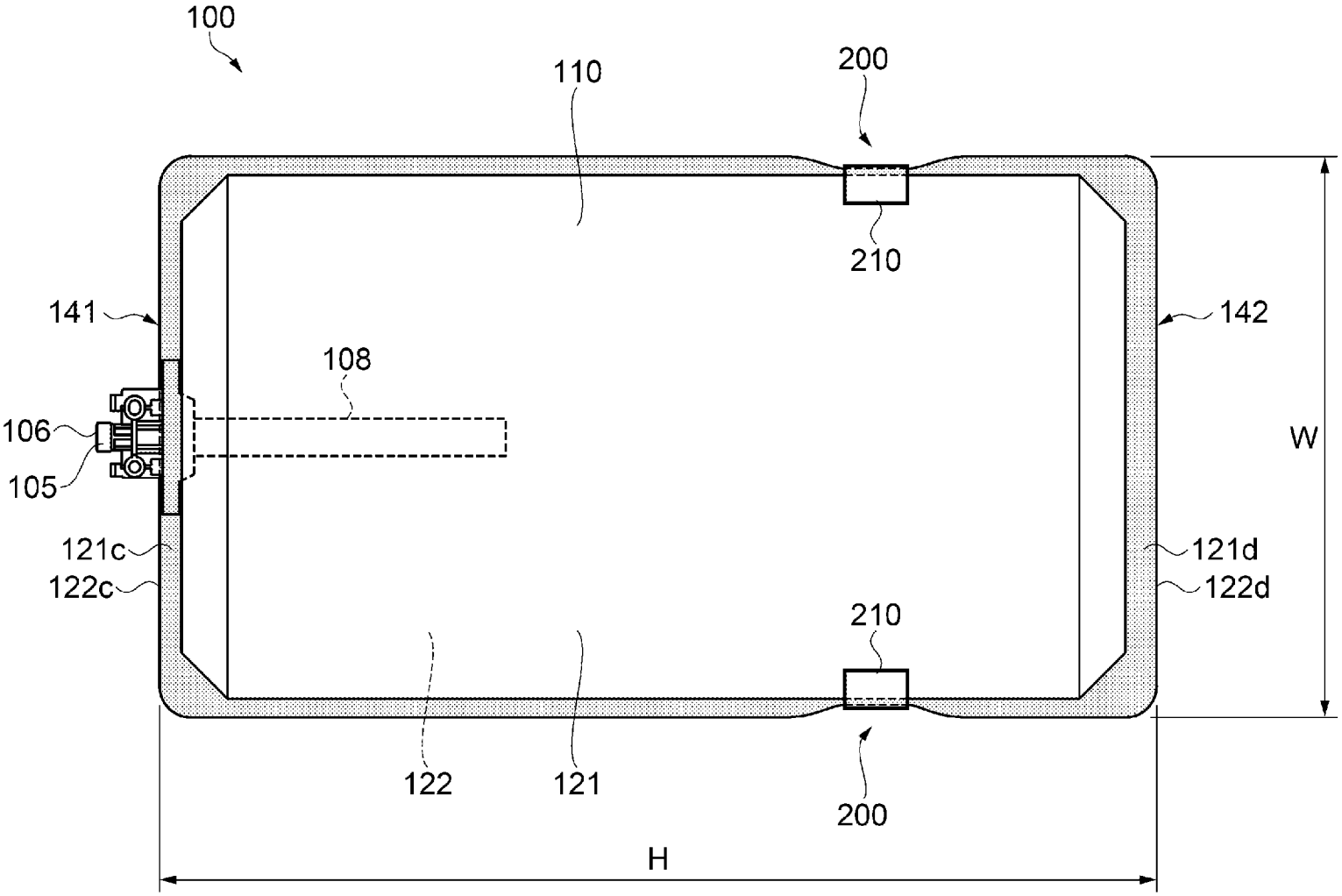
FIG. 4 is a plan view illustrating the configuration of the liquid housing container according to the first embodiment.
Figure 5:
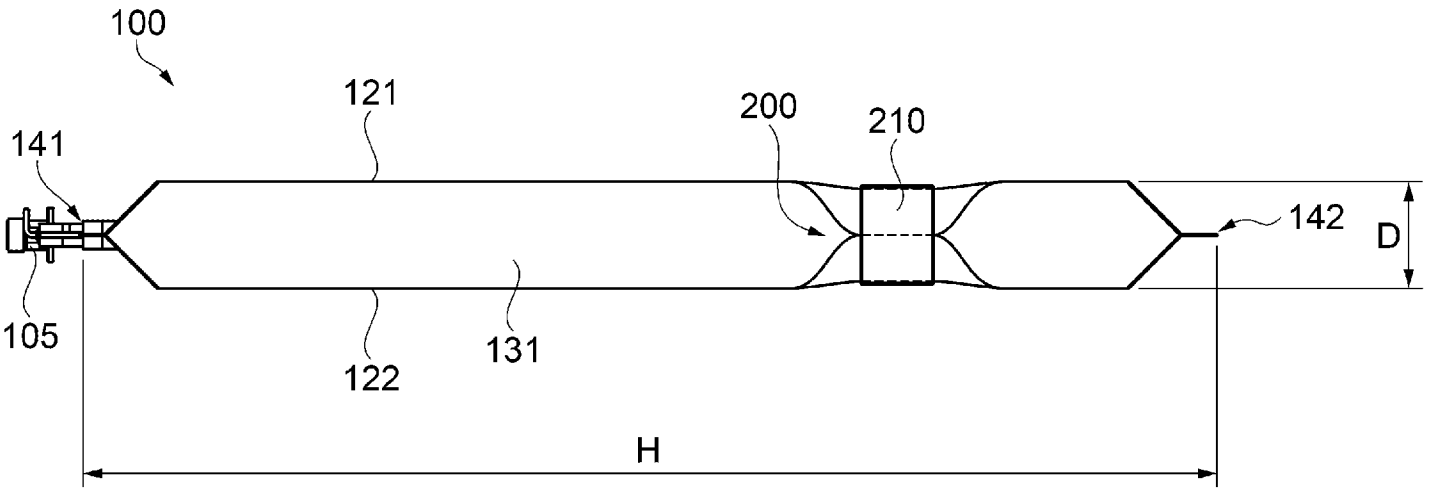
FIG. 5 is a side view illustrating the configuration of the liquid housing container according to the first embodiment.

FIG. 3 is a perspective view illustrating the configuration of the liquid housing container 100, FIG. 4 is a plan view illustrating the configuration of the liquid housing container 100, and FIG. 5 is a side view illustrating the configuration of the liquid housing container 100.

As illustrated in FIGS. 3 to 5, the liquid housing container 100 includes a flexible bag 110 capable of housing a liquid, and the lead-out portion 105 that is coupled to the flexible bag 110 and that communicates with the inside and outside of the flexible bag 110.

The flexible bag 110 has a first surface-portion film 121 that is flexible and a second surface-portion film 122 that is flexible and that faces the first surface-portion film 121. Furthermore, the flexible bag 110 has a first side-portion film 131 that is flexible and that is welded to one end portion 121*a* on a long side of the first surface-portion film 121 and one end portion 122*a* on a long side of the second surface-portion film 122, and a second side-portion film 132 that is flexible and that is welded to another end portion 121*b* on a long side of the first surface-portion film 121 on the opposite side to the one end portion 121*a* and another end portion 122*b* on a long side of the second surface-portion film 122 on the opposite side to the one end portion 122*a*. The flexible bag 110 is a substantially cuboid bag formed by heat welding the respective outer peripheral edges of the first surface-portion film 121, the second surface-portion film 122, the first side-portion film 131, and the second side-portion film 132.

In the flexible bag 110 of the present embodiment, the first side-portion film 131 is disposed by welding between the one end portion 121*a* on a long side of the first surface-portion film 121 and the one end portion 122*a* on a long side of the second surface-portion film 122.

Similarly, the second side-portion film 132 is disposed by welding between the other end portion 121*b* on a long side of the first surface-portion film 121 and the other end portion 122*b* on a long side of the second surface-portion film 122.

In addition, one end portion 121*c* on a short side of the first surface-portion film 121 and one end portion 122*c* on a short side of the second surface-portion film 122 corresponding to the one end portion 121*c* are welded to each other. In addition, another end portion 121*d* on a short side of the first surface-portion film 121 on the opposite side to the one end portion 121*c* and another end portion 122*d* on a short side of the second surface-portion film 122 on the opposite side to the one end portion 122*c* are welded to each other. Further, in FIG. 4, the portion welded by heat welding of the flexible bag 110 is hatched.

As illustrated in FIG. 4, the lead-out portion 105 is provided on the one end portions 121*c* and 122*c* side of the flexible bag 110 on a short side of the first surface-portion film 121 and the second surface-portion film 122. The lead-out portion 105 has a tube portion 108 that enables communication between the inside and outside of the flexible bag 110, and one end of the tube portion 108 is disposed inside the flexible bag 110, and the other end of the tube portion 108 is disposed outside the flexible bag 110. An outlet 106 is provided at the other end portion of the tube portion 108 disposed outside the flexible bag 110. The outlet 106 is a portion coupled to the tube 45. A partial outer peripheral surface of the lead-out portion 105 is interposed between the one end portion 121*c* on a short side of the first surface-portion film 121 and the one end portion 122*c* on a short side of the second surface-portion film 122, and heat-welded without a gap therebetween.

The first surface-portion film 121, the second surface-portion film 122, the first side-portion film 131, and the second side-portion film 132 have flexibility. The material of these films can be, for example, a multilayer body containing a resin and having a certain rigidity. As an example of the multilayer body, a multilayer body containing polyethylene terephthalate, nylon, polyethylene or the like can be applied.

The first surface-portion film 121 and the second surface-portion film 122 have a similar shape and substantially the same surface area. In addition, the first side-portion film 131 and the second side-portion film 132 have a similar shape and substantially the same surface area. The first side-portion film 131 and the second side-portion film 132 have smaller surface areas than the first surface-portion film 121 and the second surface-portion film 122. The first side-portion film 131 and the second side-portion film 132, for example, as compared with a configuration in which the first side-portion film 131 and the second side-portion film 132 are omitted, function as a gusset for increasing the amount of liquid housed in the flexible bag 110.

Suppressing portions 200 that suppress spreading of a gap between the one end portion 121*a* of the first surface-portion film 121 and the one end portion 122*a* of the second surface-portion film 122 and spreading of a gap between the other end portion 121*b* of the first surface-portion film 121 and the other end portion 122*b* of the second surface-portion film 122 are respectively provided at the one end portion 121*a* of the first surface-portion film 121 and the one end portion 122*a* of the second surface-portion film 122, and the other end portion 121*b* of the first surface-portion film 121 and the other end portion 122*b* of the second surface-portion film 122. That is, the suppressing portion 200 is provided on each of the long sides of the first surface-portion film 121 and the second surface-portion film 122.

One of the suppressing portions 200 of this embodiment is formed by pinching, with an adhesive tape 210, the one end portion 121*a* of the first surface-portion film 121 and the one end portion 122*a* of the second surface-portion film 122. Furthermore, the other one of the suppressing portions 200 is formed by pinching, with the adhesive tape 210, the other end portion 121*b* of the first surface-portion film 121 and the other end portion 122*b* of the second surface-portion film 122. Specifically, a portion where the one end portion 121*a* of the first surface-portion film 121 and the first side-portion film 131 are welded, and a portion where the one end portion 122*a* of the second surface-portion film 122 and the first side-portion film 131 are welded are each pinched by the adhesive tape 210.

More specifically, in the one of the suppressing portions 200 of the present embodiment, the one end portion 121*a* of the first surface-portion film 121 and the one end portion 122*a* of the second surface-portion film 122 are pinched with the adhesive tape 210 so that the interval (width) between the one end portion 121*a* of the first surface-portion film 121 and the one end portion 122*a* of the second surface-portion film 122 where the suppressing portion 200 is formed to be narrower than the interval (width) between the one end portion 121*a* of the first surface-portion film 121 and the one end portion 122*a* of the second surface-portion film 122 where the suppressing portions 200 is not formed. As illustrated in FIG. 5, in the one of the suppressing portions 200 of the present embodiment, the one end portion 121*a* of the first surface-portion film 121 and the one end portion 122*a* of the second surface-portion film 122 are pinched to be in contact with each other by the adhesive tape 210. In the one of the suppressing portions 200 in which the one end portion 121*a* of the first surface-portion film 121 and the one end portion 122*a* of the second surface-portion film 122 are pinched by the adhesive tape 210, the adhesive force of the adhesive tape helps to prevent the gap between the first surface-portion film 121 and the second surface-portion film 122 from spreading. Further, the configuration of the other one of the suppressing portions 200 formed on the other-end portions 121*b* and 122*b* side of the first surface-portion film 121 and the second surface-portion film 122 is the same as that above.

In addition, in the liquid housing container 100 of the present embodiment, when the one end portions 121*c* and 122*c* on the short side of the first surface-portion film 121 and the second surface-portion film 122 where the lead-out portion 105 is provided are set as a top end portion 141, and the other end portions 121*d* and 122*d* on the short side of the first surface-portion film 121 and the second surface-portion film 122 on the opposite side to the top end portion 141 are set as the bottom end portion 142, the suppressing portions 200 are provided at positions closer to the bottom end portion 142 side than the top end portion 141 side. Furthermore, the suppressing portions 200 are provided at positions away from the bottom end portion 142 toward the top end portion 141. That is, the suppressing portions 200 are provided at positions spaced apart from the leading edge of the bottom end portion 142 by a predetermined distance.

In this embodiment, as illustrated in FIGS. 4 and 5, when the outline dimensions of the flexible bag 110 are a long-side dimension H of 320 mm, a short-side dimension W of 180 mm, and a thickness-direction dimension D of 30 mm, the suppressing portions 200 are each provided at a position a distance of 25 mm or more and 100 mm or less from the leading edge of the bottom end portion 142. In the present embodiment, the suppressing portions 200 are each provided at a position 30 mm away from the bottom end portion 142. In addition, the width along the long-side direction of the first surface-portion film 121 of the adhesive tape 210 is about 10 mm. Therefore, the suppressing portions 200 of this embodiment are each provided at a position 30 mm or more and 40 mm or less away from the bottom end portion 142.

Next, the operation of the liquid housing container 100 will be described.

Figure 6:
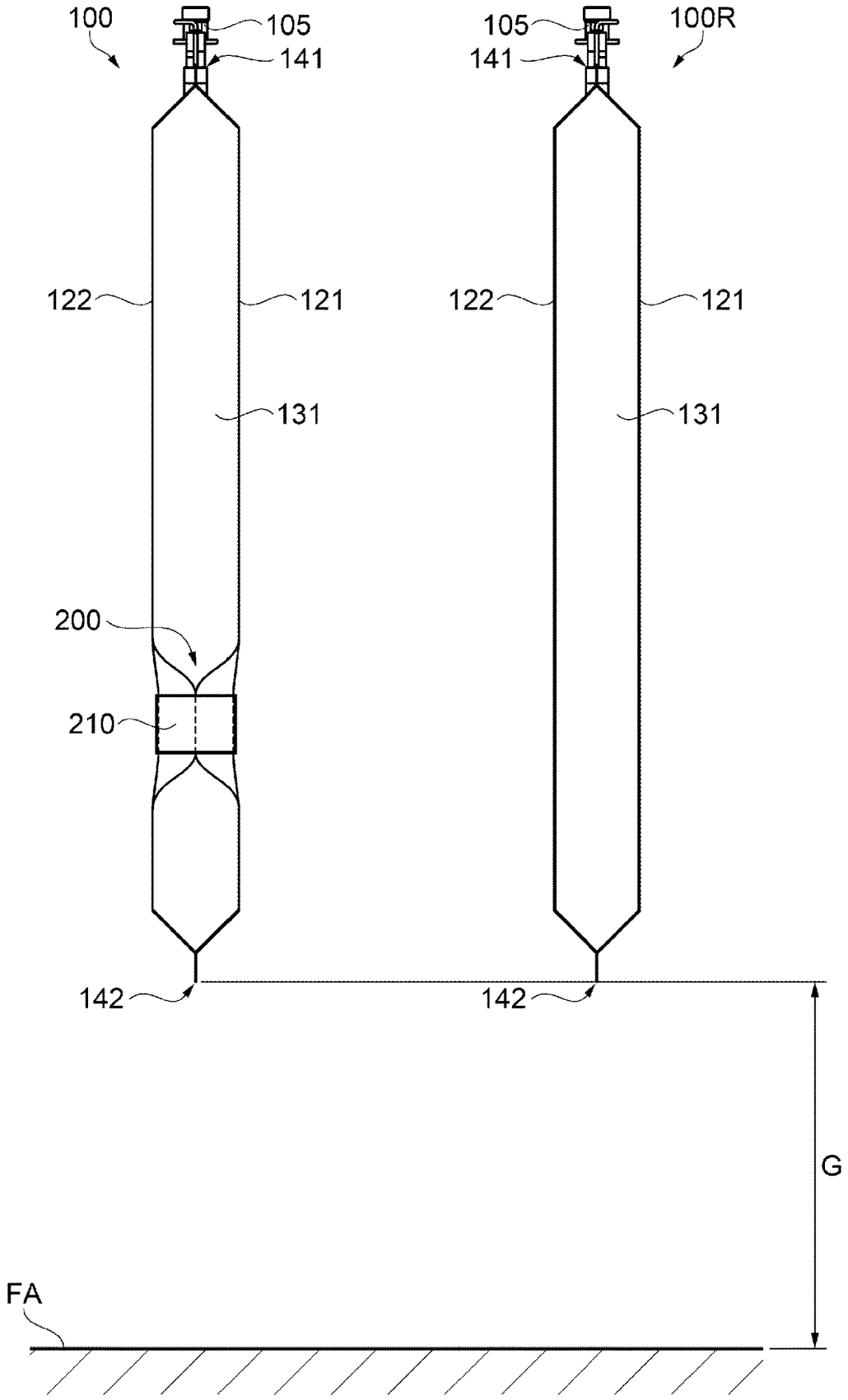
FIG. 6 is a schematic view illustrating the operation of the liquid housing container according to the first embodiment.
Figure 7:
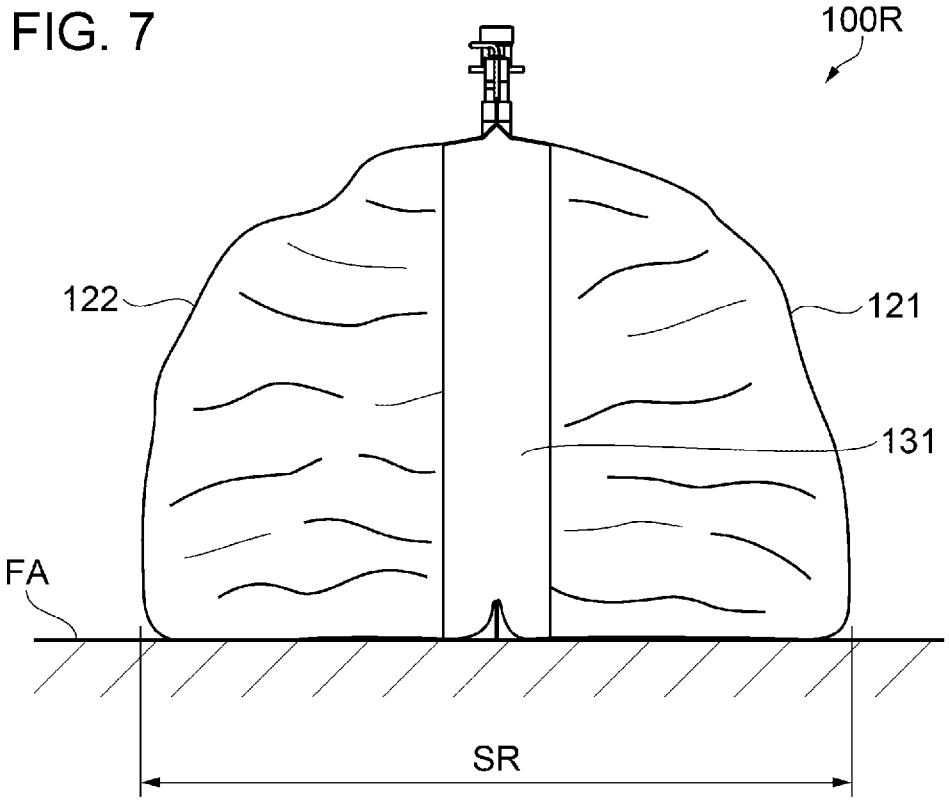
FIG. 7 is a schematic view illustrating the operation of the liquid housing container according to the first embodiment.
Figure 8:
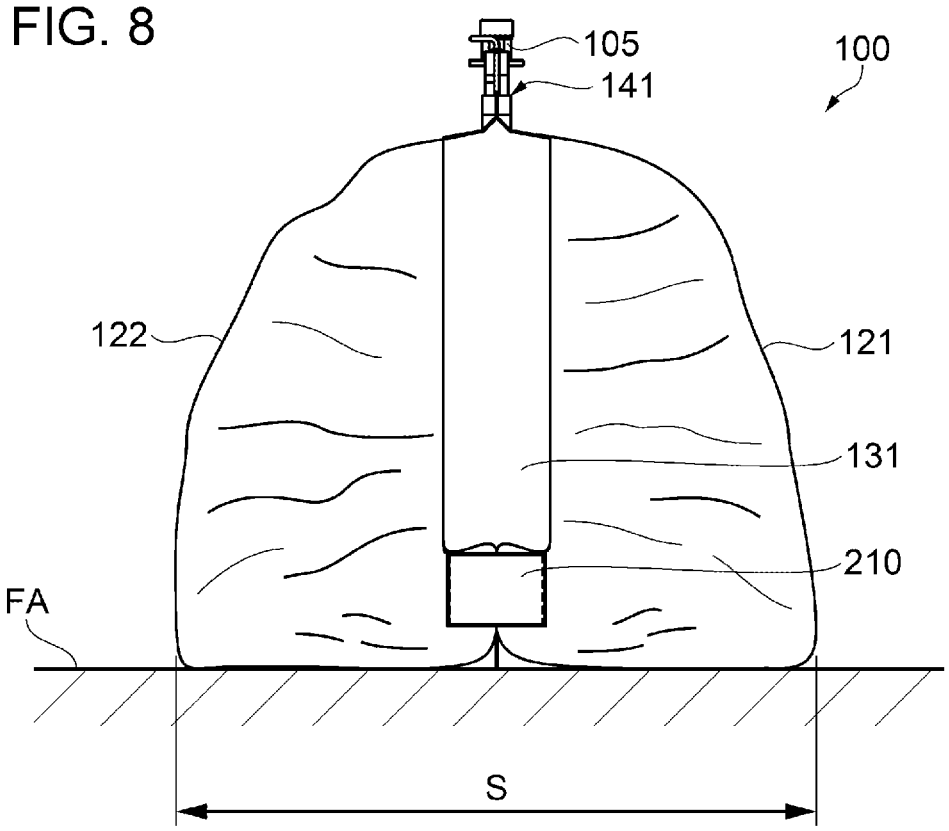
FIG. 8 is a schematic view illustrating the operation of the liquid housing container according to the first embodiment.

FIGS. 6 to 8 are schematic views illustrating the operation of the liquid housing container 100. In the present embodiment, regarding the operation of the liquid housing container 100, a drop experiment for evaluating the impact resistance of the liquid housing container 100 will be described as an example. FIG. 6 is an explanatory view illustrating an outline of the drop experiment, FIG. 7 is a schematic view illustrating a state of a liquid housing container 100R as a comparative example in the drop experiment, and FIG. 8 is a schematic view illustrating a state of the liquid housing container 100 in the drop experiment.

First, the method of the drop experiment will be described. As illustrated in FIG. 6, in the drop experiment, the liquid housing container 100 and the liquid housing container 100R as a comparative example were prepared. As for the approximate dimensions of the liquid housing container 100, the dimension H in the long side direction is 320 mm, the dimension W in the short side direction is 180 mm, and the dimension D in the thickness direction is 30 mm. The material of the flexible bag 110 of the liquid housing container 100 is a multilayer body including polyethylene. The above-described liquid housing container 100 contained 1.5 liters of ink as a liquid. As illustrated in FIG. 5, the suppressing portions 200 composed of the adhesive tape 210 were each provided at a position 30 mm or more and 40 mm or less away from the bottom end portion 142.

The approximate dimensions, material, and ink storage amount of the liquid housing container 100R are the same as those of the liquid housing container 100. The difference from the liquid housing container 100 is that the suppressing portions 200 are not provided in the liquid housing container 100R.

The liquid housing container 100 and the liquid housing container 100R are each disposed at a position where the height G is 150 cm vertically above a horizontal floor surface FA. The liquid housing container 100 and the liquid housing container 100R are disposed such that the bottom end portion 142 is directed downward in the vertical direction. Thereafter, the liquid housing container 100 and the liquid housing container 100R are dropped freely.

The pass/fail evaluation of the impact resistance was carried out by visual inspection of the liquid housing container 100 and the liquid housing container 100R after the drop experiment, and the presence or absence of damage was evaluated.

Next, evaluation results of impact resistance will be described.

In the liquid housing container 100R of the comparative example, a crack was generated in a portion of the flexible bag 110, and the ink housed in the liquid housing container 100R leaked from the crack. The location where the crack occurred was the first side-portion film 131 of the liquid housing container 100R, which was a portion about 30 mm away from the bottom end portion 142 toward the top end portion 141. That is, as for the result of the drop experiment, because the liquid housing container 100R was fatally damaged, the evaluation of the impact resistance was a fail.

On the other hand, in the liquid housing container 100, the result of the drop experiment was that there was no damage such as a crack. That is, the evaluation of impact resistance was a pass.

Next, the operation of the liquid housing container 100 will be described in detail.

As illustrated in FIG. 7, when the liquid housing container 100R is dropped toward the floor surface FA and the liquid housing container 100R collides with the floor surface FA, because the flexible bag 110 has flexibility, it deforms in such a manner as to shrink in the direction of gravity by the impact force. Along with this, the ink in the flexible bag 110 strongly flows in a direction intersecting with the direction of gravity. Thus, the flexible bag 110 expands in directions intersecting with the direction of gravity.

Here, since the first surface-portion film 121 and the second surface-portion film 122 have a larger surface area than the first side-portion film 131 and the second side-portion film 132, the flow resistance to the ink is low in the first surface-portion film 121 and the second surface-portion film 122, and the flowability of the ink along the first surface-portion film 121 and the second surface-portion film 122 is increased. That is, the sides of the first surface-portion film 121 and the second surface-portion film 122 easily swell by the pressure caused by the flow of ink. On the other hand, because the first side-portion film 131 and the second side-portion film 132 have a smaller surface area than the first surface-portion film 121 and the second surface-portion film 122, the first side-portion film 131 and the second side-portion film 132 have a high flow resistance to ink, the flowability of the ink is lower than that in the first surface-portion film 121 and the second surface-portion film 122, and the first side-portion film 131 and the second side-portion film 132 do not easily swell.

Therefore, when the liquid housing container 100R is dropped and the flexible bag 110 receives a certain impact force or more, the pressure due to the flow of ink caused by the first surface-portion film 121 and the second surface-portion film 122 becomes strong, the force cannot be absorbed, and the pressure due to the flow of ink is also applied to the first side-portion film 131 and the second side-portion film 132 sides. When the first side-portion film 131 and the second side-portion film 132 are subjected to a predetermined pressure or more, as described above, since the first side-portion film 131 and the second side-portion film 132 have difficulty swelling because the surface area of the first side-portion film 131 and the second side-portion film 132 is smaller than that of the first surface-portion film 121 and the second surface-portion film 122, the pressure due to the flow of ink cannot be absorbed, a crack occurs in a portion of the first side-portion film 131 or the second side-portion film 132, and ink leaks from the crack. From the result of the drop experiment, because the location where the crack occurred was the first side-portion film 131 of the liquid housing container 100R, and it was a portion about 30 mm away from the leading edge of the bottom end portion 142 toward the top end portion 141, it is considered that a certain amount of pressure or more is concentrated at the portion where the crack occurred.

On the other hand, in the liquid housing container 100, spreading of the gap between the one end portion 121*a* of the first surface-portion film 121 and the one end portion 122*a* of the second surface-portion film 122, and spreading of the gap between the other end portion 121*b* of the first surface-portion film 121 and the other end portion 122*b* of the second surface-portion film 122 are suppressed by the suppressing portions 200. Thereby, the flow of ink is also suppressed, and swelling due to the first surface-portion film 121 and the second surface-portion film 122 is suppressed. Accordingly, excessive swelling of the first side-portion film 131 and the second side-portion film 132 due to the flow of ink caused by the drop impact of the liquid housing container 100 is suppressed. Specifically, as illustrated in FIGS. 7 and 8, a maximum swelling dimension S between the first surface-portion film 121 and the second surface-portion film 122 in the liquid housing container 100 is smaller than a maximum swelling dimension SR between the first surface-portion film 121 and the second surface-portion film 122 in the liquid housing container 100R by about 10%.

Therefore, in the liquid housing container 100, when the ink flows toward the first side-portion film 131 and the second side-portion film 132 due to the drop impact, the suppressing portions 200 prevent the formation of excessive pressure due to the flow of ink on the first side-portion film 131 and the second side-portion film 132, and the pressure can be dispersed to the first surface-portion film 121, the second surface-portion film 122, the first side-portion film 131, the second side-portion film 132, and the suppressing portions 200. That is, the pressure concentration due to the flow of ink can be efficiently alleviated by forming the suppressing portions 200 in accordance with the location where a crack occurs when the liquid housing container 100 is dropped. That is, by suppressing or dispersing the concentration of pressure due to the flow of ink to the first side-portion film 131 and the second side-portion film 132, the occurrence of a crack or the like in the first side-portion film 131 and the second side-portion film 132 can be prevented.

Further, in the liquid housing container 100 described above, the suppressing portions 200 composed of the adhesive tape 210 are each provided at a distance of 30 mm or more and 40 mm or less from the bottom end portion 142; however, in the drop experiment, a liquid housing container 100Ra (not illustrated) was also used in which the suppressing portions 200 composed of the adhesive tape 210 were provided at a distance of 20 mm or more and 30 mm or less from the bottom end portion.

As a result, signs of cracking were observed on the top end portion 141 side of the suppressing portions 200 formed by the adhesive tape 210. This is because, when the width of the suppressing portions 200 formed by the adhesive tape 210 is 10 mm, if the suppressing portions 200 are each provided at a position too close to the bottom end portion 142, it is considered that the concentration of pressure due to the flow of ink on the first side-portion film 131 and the second side-portion film 132 cannot be suppressed or dispersed.

Therefore, as a result of verification of the drop experiment, when the width of the suppressing portions 200 formed by the adhesive tape 210 is 10 mm, it has been found that a position at a distance of 30 mm or more and 40 mm or less from the bottom end portion 142 is the optimum position at which to provide the suppressing portions 200. This is the same regardless of whether the suppressing portions 200 are formed with the same width or a smaller width by welding.

As described above, according to this embodiment, the following effects can be obtained.

When the liquid housing container 100 in which the ink as the liquid is housed is dropped, the swelling of the flexible bag 110 by the first surface-portion film 121 and the second surface-portion film 122 is suppressed by the suppressing portions 200. Along with this, excessive generation of pressure due to the flow of ink is suppressed, and as a result, excessive swelling of the first side-portion film 131 and the second side-portion film 132 is suppressed. Accordingly, concentration of pressure due to the flow of ink to the first side-portion film 131 and the second side-portion film 132 can be suppressed, and the occurrence of damage such as a crack can be prevented.

In addition, in order to enhance impact resistance, the suppressing portions 200 can be provided in a portion of the one end portions 121*a* and 122*a* of the first surface-portion film 121 and the second surface-portion film 122, and a portion of the other end portions 121*b* and 122*b* of the first surface-portion film 121 and the second surface-portion film 122 without increasing the welding area by heat welding between the outer peripheries of the first surface-portion film 121, the second surface-portion film 122, the first side-portion film 131, and the second side-portion film 132. Thus, the housing efficiency of the ink housed in the flexible bag 110 is not reduced. That is, in the liquid housing container 100 of the present embodiment, the impact resistance is enhanced without impairing the volume efficiency for housing the ink.

Second Embodiment

Next, a second embodiment will be described. Further, because the configurations of the liquid ejecting apparatus 11 and the liquid housing apparatus 50 are the same as those of the first embodiment, the description thereof will be omitted, and a configuration of a liquid housing container 100*a* different from the configuration of the first embodiment will be described.

Figure 9:
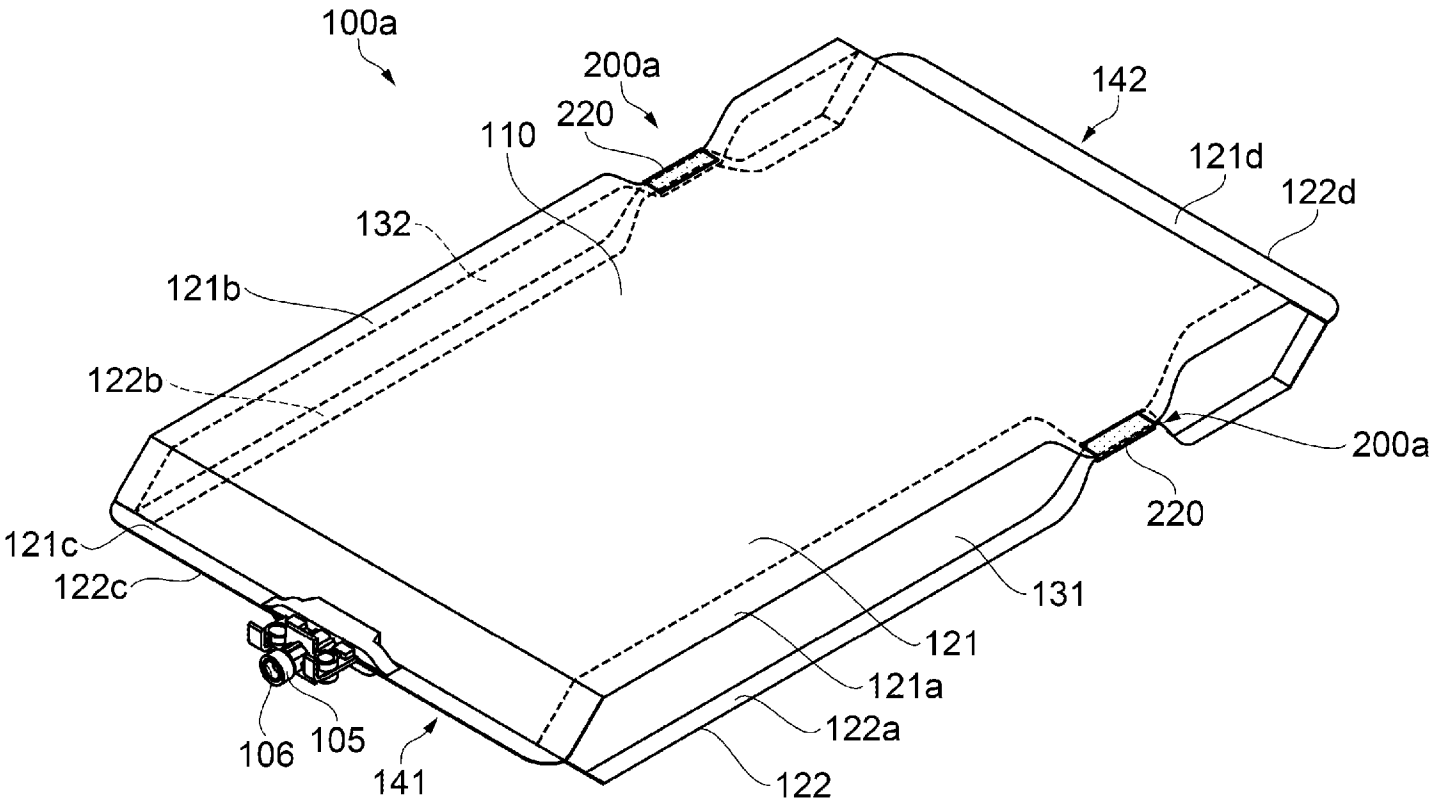
FIG. 9 is a perspective view illustrating a configuration of a liquid housing container according to a second embodiment.
Figure 10:
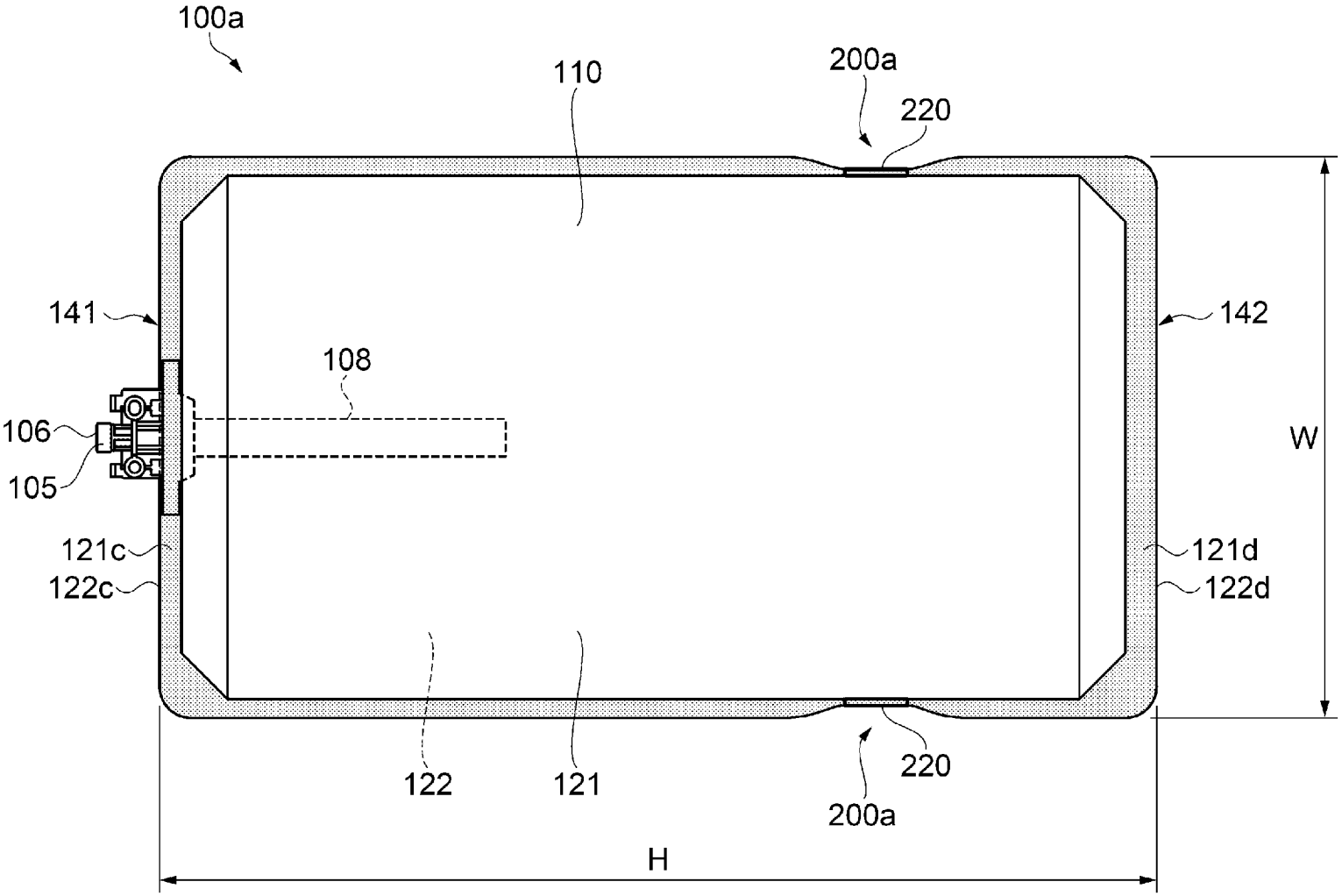
FIG. 10 is a plan view illustrating the configuration of the liquid housing container according to the second embodiment.
Figure 11:
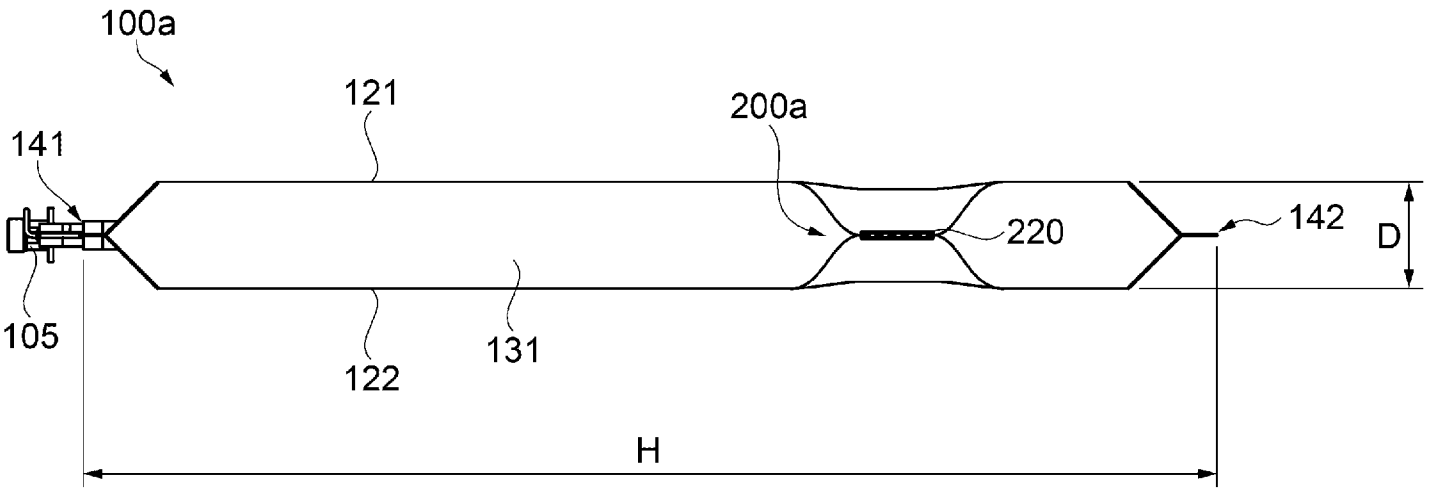
FIG. 11 is a side view illustrating the configuration of the liquid housing container according to the second embodiment.

FIG. 9 is a perspective view illustrating the configuration of the liquid housing container 100*a*, FIG. 10 is a plan view illustrating the configuration of the liquid housing container 100*a*, and FIG. 11 is a side view illustrating the configuration of the liquid housing container 100*a*.

As illustrated in FIGS. 9 to 11, the liquid housing container 100*a* includes the flexible bag 110 capable of containing a liquid, and the lead-out portion 105 that is coupled to the flexible bag 110 and that enables communication between the inside and outside of the flexible bag 110. Further, the configurations of the flexible bag 110 and the lead-out portion 105 are the same as in the first embodiment, and thus the description thereof is omitted.

In the liquid housing container 100*a*, suppressing portions 200*a* that suppress spreading of a gap between the one end portion 121*a* of the first surface-portion film 121 and the one end portion 122*a* of the second surface-portion film 122 and spreading of a gap between the other end portion 121*b* of the first surface-portion film 121 and the other end portion 122*b* of the second surface-portion film 122 are respectively provided at the one end portion 121*a* of the first surface-portion film 121 and the one end portion 122*a* of the second surface-portion film 122, and the other end portion 121*b* of the first surface-portion film 121 and the other end portion 122*b* of the second surface-portion film 122. That is, the suppressing portions 200*a* are provided on both the long sides of the first surface-portion film 121 and the second surface-portion film 122.

One of the suppressing portions 200*a* of this embodiment is formed by welding the one end portion 121*a* of the first surface-portion film 121 and the one end portion 122*a* of the second surface-portion film 122. Furthermore, the other is formed by welding the other end portion 121*b* of the first surface-portion film 121, and the other end portion 122*b* of the second surface-portion film 122.

Specifically, as illustrated in FIG. 11, in the suppressing portions 200*a*, a first portion and a second portion are fixed by welding. The first portion is a portion where the one end portion 121*a* of the first surface-portion film 121 and the first side-portion film 131 are welded. The second portion is a portion where the one end portion 122*a* of the second surface-portion film 122 and the first side-portion film 131 are welded.

More specifically, the suppressing portions 200*a* of the present embodiment are fixed by welding in such a manner that the interval between the one end portion 121*a* of the first surface-portion film 121 and the one end portion 122*a* of the second surface-portion film 122 is narrower than the interval between the one end portion 121*a* of the first surface-portion film 121 and the one end portion 122*a* of the second surface-portion film 122 where the suppressing portions 200*a* are not formed. That is, the suppressing portions 200*a* are formed by spot welding. The suppressing portions 200*a* of the present embodiment each have a welding portion 220 in which the one end portion 121*a* of the first surface-portion film 121 and the one end portion 122*a* of the second surface-portion film 122 are welded and fixed. In one of the suppressing portions 200*a* formed by welding of the one end portion 121*a* of the first surface-portion film 121 and the one end portion 122*a* of the second surface-portion film 122, spreading between the first surface-portion film 121 and the second surface-portion film 122 is suppressed by the welding force at the welding portion 220. Further, the configuration of the other one of the suppressing portions 200*a* on the other end portions 121*b* and 122*b* side of the first surface-portion film 121 and the second surface-portion film 122 is the same as that described above.

In addition, in the liquid housing container 100*a* of the present embodiment, when the one end portions 121*c* and 122*c* of the first surface-portion film 121 and the second surface-portion film 122 provided with the lead-out portion 105 are used as the top end portion 141, and the other end portions 121*d* and 122*d* of the first surface-portion film 121 and the second surface-portion film 122 on the opposite side to the top end portion 141 are used as the bottom end portion 142, the suppressing portions 200*a* are provided at positions closer to the bottom end portion 142 side than the top end portion 141 side. Furthermore, the suppressing portions 200*a* are provided at positions away from the bottom end portion 142 toward the top end portion 141.

The approximate dimensions of the flexible bag 110 of the liquid housing container 100*a* of the present embodiment are the same as those of the first embodiment, and the suppressing portions 200*a* are each provided at a distance of 30 mm or more and 40 mm or less from the bottom end portion 142. Further, the width of the welding portions 220 along the long side direction of the first surface-portion film 121 is about 10 mm.

As described above, according to the present embodiment, in the liquid housing container 100*a*, the swelling between the first surface-portion film 121 and the second surface-portion film 122 is suppressed by the welding force of the welding portions 220 in the suppressing portions 200*a*, and as in the first embodiment, impact resistance is enhanced without compromising the volume efficiency for housing the liquid.

Further, the present disclosure is not limited to the above-described embodiment, and various modifications, improvements, and the like may be added to the above-described embodiment. Modifications are described below.

Modification 1

Figure 12:
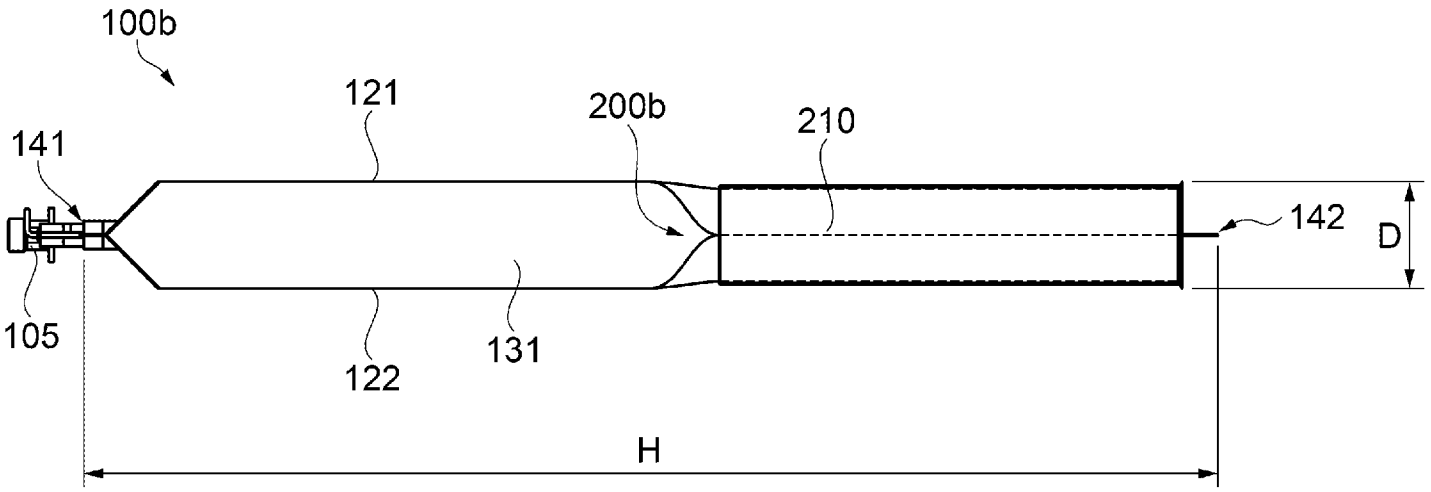
FIG. 12 is a side view illustrating a configuration of a liquid housing container according to a modification 1.

In the first embodiment, the suppressing portions 200 are provided at positions separated from the bottom end portion 142, but are not limited to this. FIG. 12 is a side view illustrating the configuration of a liquid housing container 100*b* according to the present modification.

As illustrated in FIG. 12, a suppressing portion 200*b* of the liquid housing container 100*b* is continuously formed from the bottom end portion 142 to a predetermined position. In this case, if the adhesive tape 210, which is wide, is used, the suppressing portion 200*b* can be easily formed. Furthermore, the suppressing portion 200*b* may be formed in the wider part from the bottom end portion 142 to the top end portion 141. Also in this case, excessive swelling of the first surface-portion film 121 and the second surface-portion film 122 can be suppressed. Further, the suppressing portion 200*b* need not be formed by using the adhesive tape 210 and may be formed by welding.

Modification 2

Figure 13:
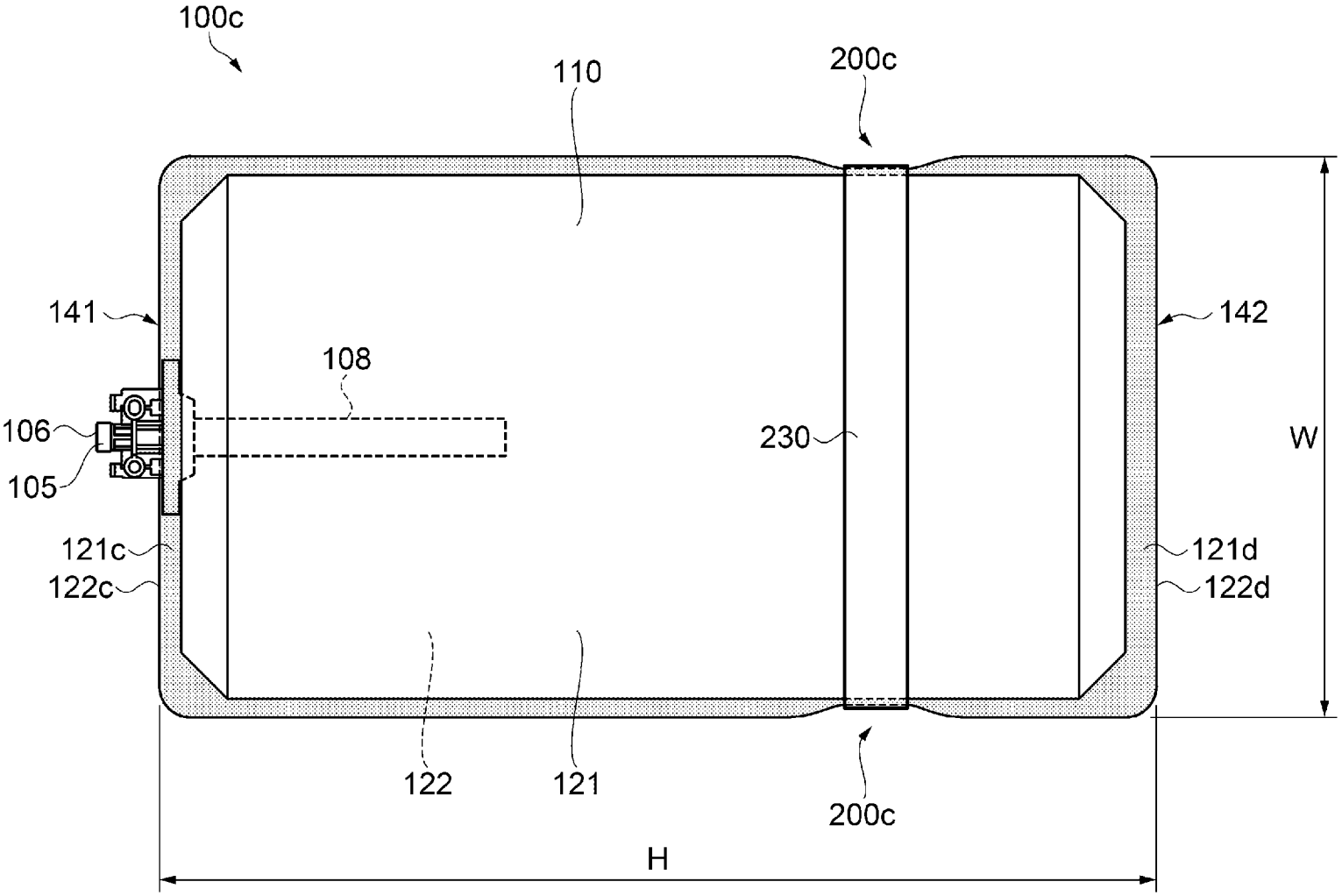
FIG. 13 is a plan view illustrating a configuration of a liquid housing container according to a modification 2.

In the first embodiment, the suppressing portions 200 are formed by adhering the adhesive tape 210 on a portion of each of the one end portions 121*a*, 122*a* and the other end portions 121*b*, 122*b*, but the present disclosure is not limited to this. FIG. 13 is a plan view illustrating the configuration of a liquid housing container 100*c* according to the present modification.

As illustrated in FIG. 13, a suppressing portion 200*c* of the liquid housing container 100*c* may be formed by a strip 230. Specifically, the strip 230 has a cylindrical shape. The inner circumferential length of the strip 230 is shorter than the outer circumferential length of the short side of the flexible bag 110. Then, by arranging the strip 230 along the outer periphery on the short side of the flexible bag 110, spreading of the gap between the one end portion 121*a* of the first surface-portion film 121 and the one end portion 122*a* of the second surface-portion film 122 and spreading of the gap between of the other end portion 121*b* of the first surface-portion film 121 and the other end portion 122*b* of the second surface-portion film 122 can be suppressed. Further, the strip 230 may be an elastic body such as a resin film or rubber, or may be a non-elastic body such as a metal or a cured resin. In addition, the flexible bag 110 may be wound with an adhesive tape. Even in this case, the same effect can be obtained.

Modification 3

Figure 14:
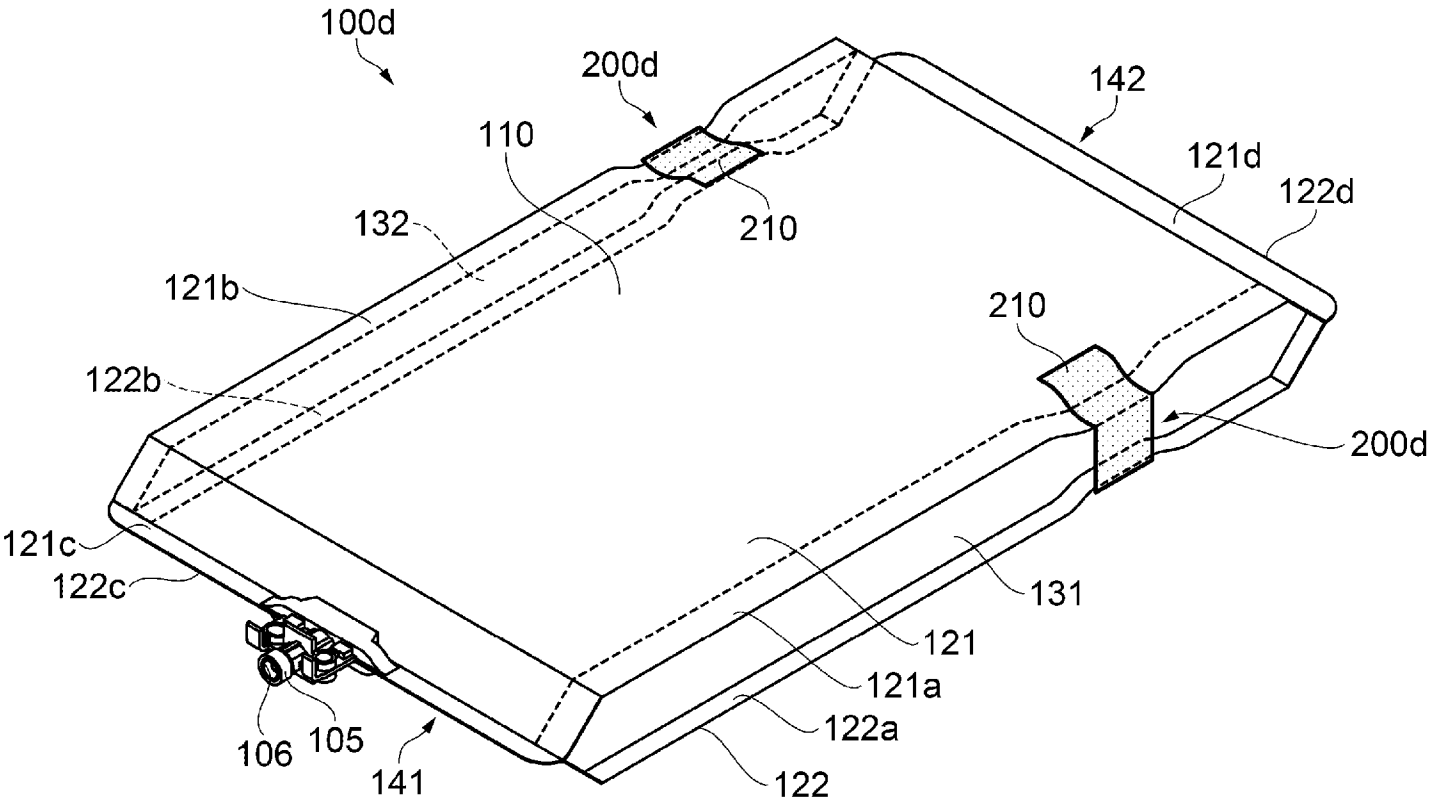
FIG. 14 is a perspective view illustrating a configuration of a liquid housing container according to a modification 3.

In the suppressing portions 200 of the first embodiment, although the adhesive tape 210 is configured to hold the one end portion 121*a* of the first surface-portion film 121 and the one end portion 122*a* of the second surface-portion film 122 in contact with each other, it is not limited to this. FIG. 14 is a perspective view illustrating the configuration of a liquid housing container 100*d* according to this modification. As illustrated in FIG. 14, although suppressing portions 200*d* are configured to be held by the adhesive tape 210 in a state in which there is a gap between the one end portion 121*a* of the first surface-portion film 121 and the one end portion 122*a* of the second surface-portion film 122, the same effect as described above can be obtained as long as the interval between the one end portions 121*a* and 122*a* is narrower than that when not held by the adhesive tape 210.

Modification 4

Although the suppressing portions 200*a* of the second embodiment are configured to be formed by welding the one end portion 121*a* of the first surface-portion film 121 and the one end portion 122*a* of the second surface-portion film 122, and the other end portion 121*b* of the first surface-portion film 121 and the other end portion 122*b* of the second surface-portion film 122, they are not limited to this. For example, instead of welding, the suppressing portions 200*a* may be configured to be adhered by an adhesive. Even in this case, the same effect as described above can be obtained.

Modification 5

Although the suppressing portions 200 of the first embodiment are each provided at one position respectively on the one end portion 121*a* of the first surface-portion film 121 and the one end portion 122*a* of the second surface-portion film 122, and the other end portion 121*b* of the first surface-portion film 121 and the other end portion of 122*b* of the second surface-portion film 122, they are not limited to this. For example, the suppressing portions 200 may be provided at a plurality of positions respectively on the one end portion 121*a* of the first surface-portion film 121 and the one end portion 122*a* of the second surface-portion film 122, and the other end portion 121*b* of the first surface-portion film 121 and the other end portion of 122*b* of the second surface-portion film 122. Even in this case, the same effect as described above can be obtained. In addition, the suppressing portions 200*a* of the second embodiment may similarly be provided at multiple positions.

The contents derived from the embodiment will be described below.

A liquid housing container includes: a flexible bag configured to contain a liquid; and a lead-out portion coupled to the flexible bag and communicating with inside and outside of the flexible bag, in which the flexible bag includes a first surface-portion film that is flexible and rectangular, a second surface-portion film that is flexible, rectangular, and provided opposite the first surface-portion film, a first side-portion film that is flexible and welded to one end portion on a long side of the first surface-portion film and one end portion on a long side of the second surface-portion film, a second side-portion film that is flexible and welded to another end portion on the long side of the first surface-portion film opposite to the one end portion on the long side of the first surface-portion film and another end portion on the long side of the second surface-portion film opposite to the one end portion on the long side of the second surface-portion film, the first side-portion film and the second side-portion film having a surface area smaller than a surface area of the first surface-portion film and the second surface-portion film, and a suppressing portion that is provided on the one end portion on the long side of the first surface-portion film and the one end portion on the long side of the second surface-portion film, and the other end portion on the long side of the first surface-portion film and the other end portion on the long side of the second surface-portion film, and that suppresses spreading of a gap between the one end portion on the long side of the first surface-portion film and the one end portion on the long side of the second surface-portion film and spreading of a gap between the other end portion on the long side of the first surface-portion film and the other end portion on the long side of the second surface-portion film, in which.

According to this aspect, for example, in the case where the liquid housing container housing the liquid is dropped against the floor surface in the direction of gravity, when the liquid housing container collides with the floor surface, the flexible bag has flexibility so that it is deformed to contract in the direction of gravity by the impact force. Along with this, the liquid in the flexible bag flows in directions intersecting the direction of gravity. That is, the liquid in the flexible bag flows to the first and second surface-portion film sides and the first and second side-portion film sides in directions intersecting the direction of gravity. Thus, the flexible bag will become inflated in the directions intersecting the direction of gravity.

Here, since the first and second surface-portion films have a larger surface area than the first and second side-portion films, the flow resistance to the liquid is low and the flowability of the liquid is high. If the suppressing portion is not formed, it is easy for the first and second surface-portion film sides to swell greatly by the fluid flow pressure. On the other hand, since the first and second side-portion films have a surface area smaller than the surface area of the first and second surface-portion films, the flow resistance of the liquid is higher than that in the case of the first and second surface-portion films and the flowability of the liquid is low. Because of this, the first and second side-portion films have difficulty swelling. That is, the first and second side-portion films do not easily relieve the pressure due to the movement of the liquid.

Therefore, when the liquid housing container in which the suppressing portion is not formed is dropped and the flexible bag receives a certain impact force or more, since the pressure due to the large flow of liquid by the first and second surface-portion films is not sufficiently absorbed, the pressure due to the flow of liquid is also applied to the first and second side-portion film sides. Then, a certain pressure or more is applied to the first and second side-portion film sides, the first and second side-portion films may not sufficiently absorb the pressure due to the flow of such liquid, and a crack may occur in a portion of the first side-portion film or the second side-portion film and the liquid may leak out of the flexible bag.

Therefore, according to the above configuration, spreading of a gap between the one end portion of the first surface-portion film and the one end portion of the second surface-portion film, and spreading of a gap between the other end portion of the first surface-portion film and the other end portion of the second surface-portion film are suppressed by the suppressing portion, and, as a result, excessive swelling of the first and second side-portion films due to flow of liquid is suppressed. Thus, even if the liquid flows to the first and second side-portion film sides, the suppressing portion suppresses the swelling of the first surface-portion film and the second surface-portion film, and because the flow of liquid is also suppressed, the pressure due to the flow of liquid to the first and second side-portion films is also suppressed and dispersed. As a result, concentration of pressure due to flow of liquid to the first and second side-portion films is suppressed, and the occurrence of cracks in the first and second side-portion films is prevented.

In addition, the suppressing portion is provided at the one end portions of the first and second surface-portion films and the other end portions of the first and second surface-portion films in order to increase the strength of the flexible bag, and the welding area between the films is not increased. Thus, the volume efficiency of the liquid housed in the flexible bag is not reduced.

According to the above configuration, it is possible to provide a liquid housing container with improved impact resistance without compromising the volume efficiency for housing the liquid.

In the liquid housing container, when one end portion on a short side of the first surface-portion film and one end portion on a short side of the second surface-portion film corresponding to the one end portion on the short side of the first surface-portion film are set as a top end portion, and another end portion on the opposite side to the one end portion on the short side of the first surface-portion film and another end portion on the opposite side to the one end portion on the short side of the second surface-portion film are set as a bottom end portion, the lead-out portion may be provided on a top end portion side, and the suppressing portion may be provided at a position closer to a bottom end portion side than the top end portion side, and may be provided at a position separated from the bottom end portion toward the top end portion.

According to this configuration, the suppressing portion is provided at a position away from the bottom end portion. That is, for example, it becomes possible to partially dispose the suppressing portion in accordance with the portion where the first side-portion film or the second side-portion film is likely to be cracked by the impact when the liquid housing container is dropped. Thereby, the deformation of the flexible bag can be efficiently suppressed, and the pressure concentration due to the flow of liquid can be alleviated. Furthermore, it is possible to prevent a drop in the volume efficiency for housing the liquid.

In the liquid housing container described above, the suppressing portion may be provided at a distance of 25 mm or more and 100 mm or less from the bottom end portion.

According to this configuration, the suppressing portion can be disposed as accurately as possible at a location where a crack is likely to be generated in the first side-portion film or the second side-portion film due to an impact when the liquid housing container is dropped.

In the liquid housing container, among a width between the one end portion on the long side of the first surface-portion film and the one end portion on the long side of the second surface-portion film, and a width between the other end portion on the long side of the first surface-portion film and the other end portion on the long side of the second surface-portion film, the width of portions where the suppressing portion is provided may be narrower than the width of portions where the suppressing portions are not provided.

According to this configuration, it is possible to efficiently suppress spreading of a gap between the one end portion of the first surface-portion film and the one end portion of the second surface-portion film, and spreading of a gap between the other end portion of the first surface-portion film and the other end portion of the second surface-portion film.

In the liquid housing container, the suppressing portion may be formed by respectively pinching, with an adhesive tape, the one end portion on the long side of the first surface-portion film and the one end portion on the long side of the second surface-portion film, and the other end portion on the long side of the first surface-portion film and the other end portion on the long side of the second surface-portion film.

According to this configuration, the suppressing portion can reliably suppress spreading of a gap between the one end portion of the first surface-portion film and the one end portion of the second surface-portion film, and spreading of a gap between the other end portion of the first surface-portion film and the other end portion of the second surface-portion film by pinching these portions with the adhesive tape.

In the liquid housing container, the suppressing portion may be formed by respectively welding the one end portion on the long side of the first surface-portion film and the one end portion on the long side of the second surface-portion film, and the other end portion on the long side of the first surface-portion film and the other end portion on the long side of the second surface-portion film.

According to this configuration, the suppressing portion can reliably suppress spreading of a gap between the one end portion of the first surface-portion film and the one end portion of the second surface-portion film, and spreading of a gap between the other end portion of the first surface-portion film and the other end portion of the second surface-portion film by a welding force due to welding.

A liquid housing apparatus includes the liquid housing container and a holder for storing the liquid housing container.

According to this configuration, it is possible to provide the liquid housing apparatus in which the liquid housing container having improved impact resistance is stored in the holder without impairing the volume efficiency for housing the liquid.

A liquid ejecting apparatus includes the liquid housing apparatus.

According to this configuration, it is possible to provide a highly reliable liquid ejecting apparatus without the problems caused by liquid leakage in the liquid housing container.

What is claimed is:

1. A liquid housing container comprising:

a flexible bag configured to contain a liquid; and a lead-out portion coupled to the flexible bag and communicating with inside and outside of the flexible bag, wherein the flexible bag includes a first surface-portion film that is flexible and rectangular, a second surface-portion film that is flexible, rectangular, and provided opposite the first surface-portion film, a first side-portion film that is flexible and welded to one end portion on a long side of the first surface-portion film and one end portion on a long side of the second surface-portion film, a second side-portion film that is flexible and welded to another end portion on the long side of the first surface-portion film opposite to the one end portion on the long side of the first surface-portion film and another end portion on the long side of the second surface-portion film opposite to the one end portion on the long side of the second surface-portion film, the first side-portion film and the second side-portion film having a surface area smaller than a surface area of the first surface-portion film and the second surface-portion film, and a suppressing portion that is provided on the one end portion on the long side of the first surface-portion film and the one end portion on the long side of the second surface-portion film, and the other end portion on the long side of the first surface-portion film and the other end portion on the long side of the second surface-portion film, and that suppresses expansion of a space between the one end portion on the long side of the first surface-portion film and the one end portion on the long side of the second surface-portion film and expansion of a space between the other end portion on the long side of the first surface-portion film and the other end portion on the long side of the second surface-portion film, wherein the suppressing portion is spaced apart from a top end portion that is an end portion on the short side of the first surface-portion film and an end portion on the short side of the second surface-portion film, and the suppressing portion is spaced apart from a bottom end portion that is an other end portion on the short side of the first surface-portion film and an other end portion on the short side of the second surface-portion film.

2. The liquid housing container according to claim 1, wherein when one end portion on a short side of the first surface-portion film and one end portion on a short side of the second surface-portion film corresponding to the one end portion on the short side of the first surface-portion film are set as a top end portion, and another end portion on an opposite side to the one end portion on the short side of the first surface-portion film and another end portion on an opposite side to the one end portion on the short side of the second surface-portion film are set as a bottom end portion, the lead-out portion is provided on a top end portion side, and the suppressing portion is provided at a position closer to a bottom end portion side than the top end portion side, and is provided at a position separated from the bottom end portion toward the top end portion.

3. The liquid housing container according to claim 2, wherein the suppressing portion is provided at a distance of 25 mm or more and 100 mm or less from the bottom end portion.

4. The liquid housing container according to claim 1, wherein among a width between the one end portion on the long side of the first surface-portion film and the one end portion on the long side of the second surface-portion film, and a width between the other end portion on the long side of the first surface-portion film and the other end portion on the long side of the second surface-portion film, the width of portions where the suppressing portion is provided is narrower than the width of portions where the suppressing portion is not provided.

5. The liquid housing container according to claim 1, wherein the suppressing portion is formed by respectively pinching, with an adhesive tape, the one end portion on the long side of the first surface-portion film and the one end portion on the long side of the second surface-portion film, and the other end portion on the long side of the first surface-portion film and the other end portion on the long side of the second surface-portion film.

6. The liquid housing container according to claim 1, wherein the suppressing portion is formed by respectively welding the one end portion on the long side of the first surface-portion film and the one end portion on the long side of the second surface-portion film, and the other end portion on the long side of the first surface-portion film and the other end portion on the long side of the second surface-portion film.

7. A liquid housing apparatus comprising:

the liquid housing container according to claim 1; and a holder for storing the liquid housing container.

8. A liquid ejecting apparatus comprising:

the liquid housing apparatus according to claim 7.

* * * * *